United States Patent [19]

Gavronsky et al.

[11] Patent Number: 4,611,736

[45] Date of Patent: Sep. 16, 1986

[54] TAPE FEEDING APPARATUS FOR MAILING MACHINE

[75] Inventors: German Gavronsky, Stamford; Leo Wologodzew, Huntington, both of Conn.

[73] Assignee: Pitney Bowes Inc., Stamford, Conn.

[21] Appl. No.: 704,839

[22] Filed: Feb. 25, 1985

[51] Int. Cl.[4] ..... B65H 20/04

[52] U.S. Cl. ..... 226/134; 226/152; 226/188; 101/228

[58] Field of Search ..... 226/37, 143, 152, 188, 226/134; 101/227, 232, 235, 228, 35-37

[56] References Cited

U.S. PATENT DOCUMENTS

| | | | |
|---|---|---|---|
| 2,141,119 | 12/1938 | Wheeler et al. | 101/91 |
| 2,204,972 | 6/1940 | Rovan et al. | 101/227 |
| 2,273,294 | 2/1942 | Strother | 101/235 |
| 2,415,762 | 2/1947 | Ryan et al. | 101/228 |
| 2,427,968 | 2/1969 | Viola | 101/228 |
| 2,934,009 | 4/1960 | Bach et al. | 101/235 |
| 3,761,000 | 9/1973 | Hagstrom | 226/37 |
| 3,974,951 | 8/1976 | Kibler | 226/143 |

*Primary Examiner*—John M. Jillions

*Attorney, Agent, or Firm*—Martin D. Wittstein; William D. Soltow, Jr.; Albert W. Scribner

[57] ABSTRACT

A tape feeding apparatus is provided for preventing the feeding of successive strips of tape unless and until the manual activator for the tape feeding mechanism has been allowed to return to its manual in operative position. There is a tape feeding apparatus, a drive apparatus for driving the tape feeding apparatus, and a clutch interposed there between. A latching mechanism normally maintains the clutch disengaged to prevent the driving apparatus from driving the tape feeding apparatus. A second clutch is interposed between the latching mechanism and a manually movable actuator for normally engaging and providing a direct connection between the movable actuator and the latching mechanism so as to disable the latching mechanism when the actuator is moved to the actuating position, and thus allowing the first clutch to engage and cause the driving apparatus to drive the tape feeding apparatus.

7 Claims, 8 Drawing Figures

Fig. 3.
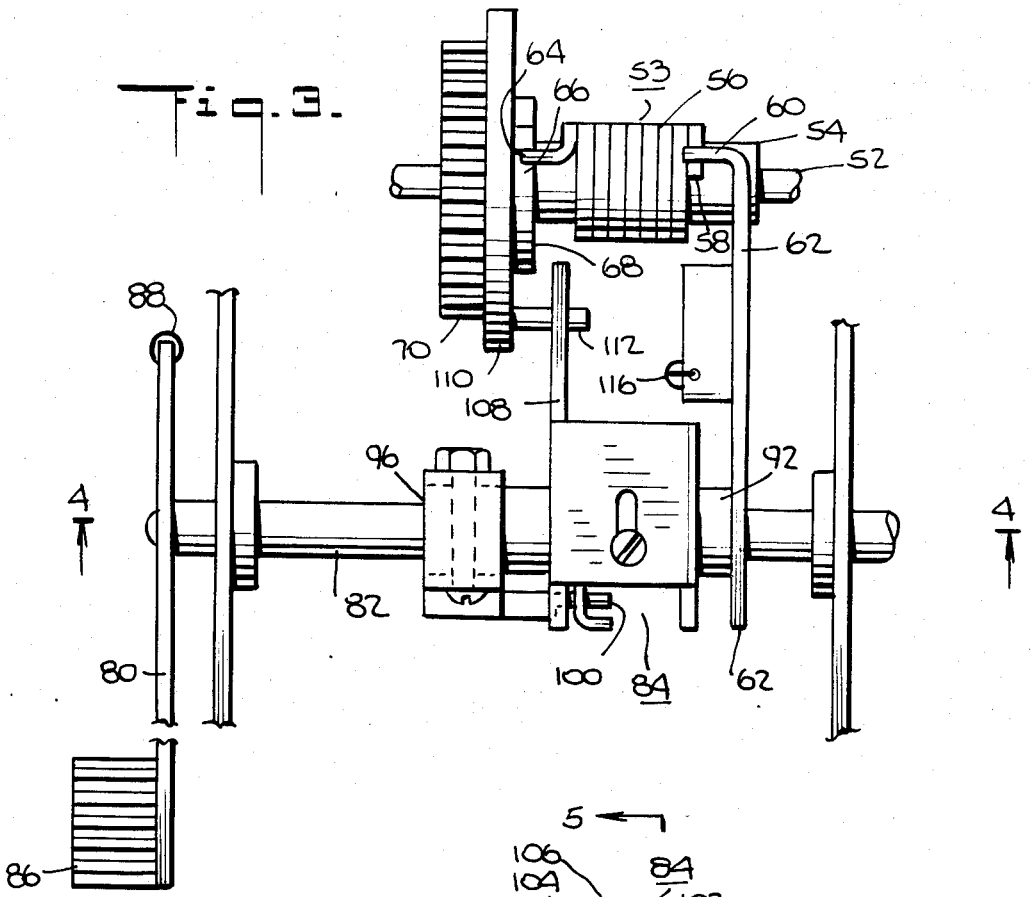
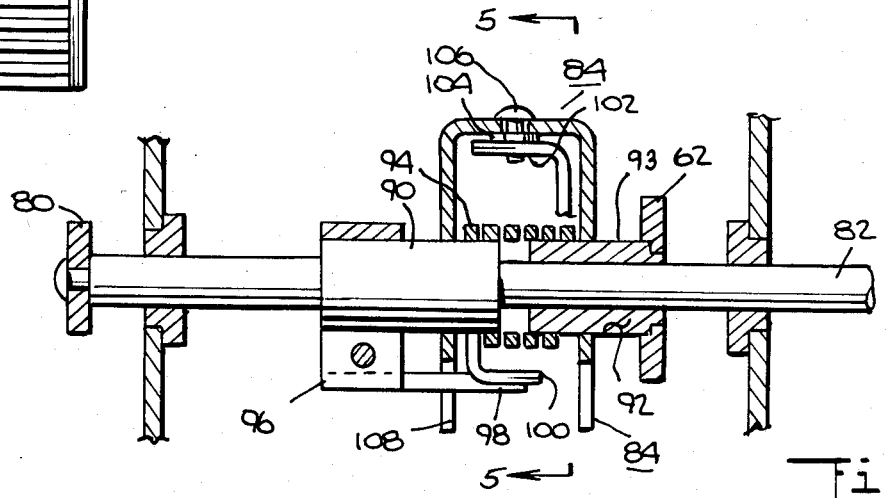
Fig. 4.
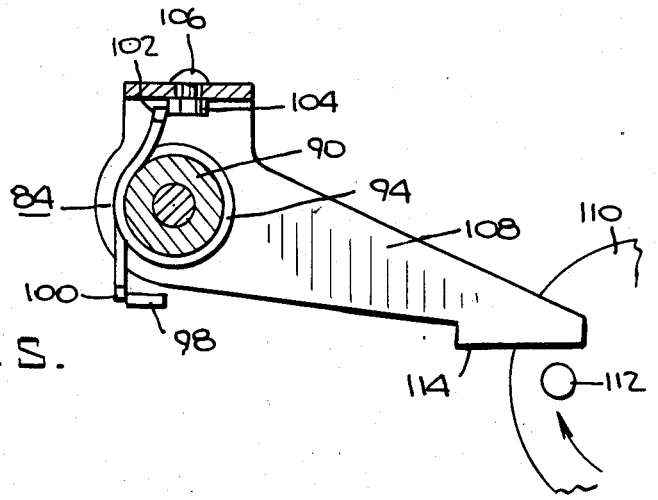
Fig. 5.

Fig. 6.
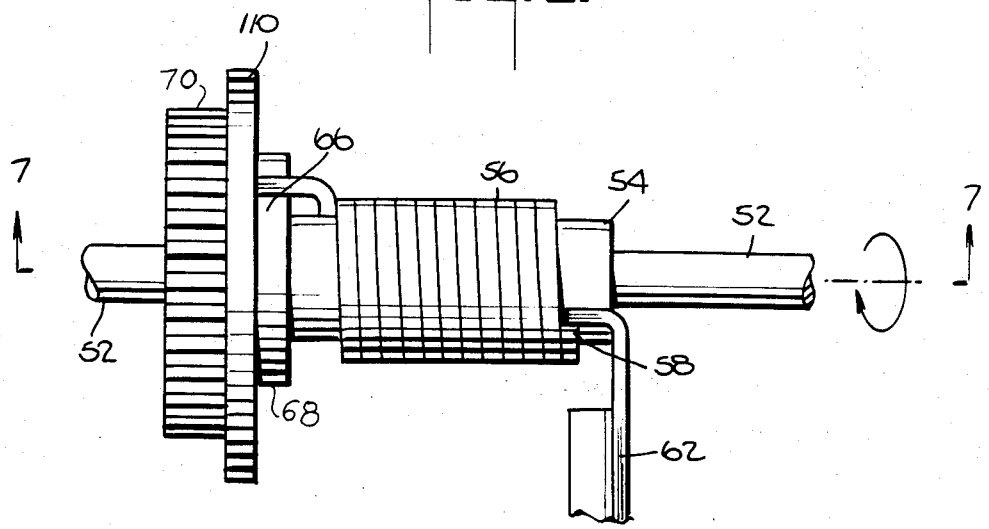
Fig. 8.
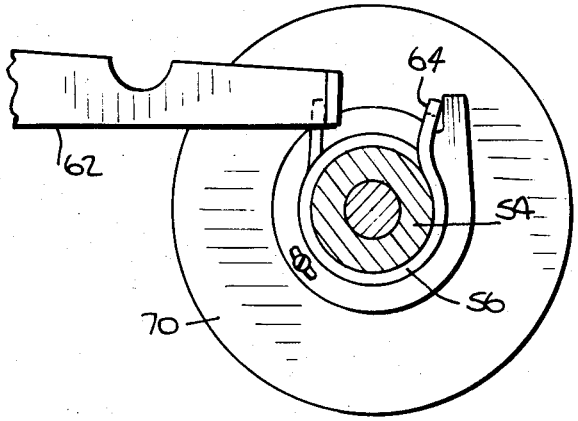
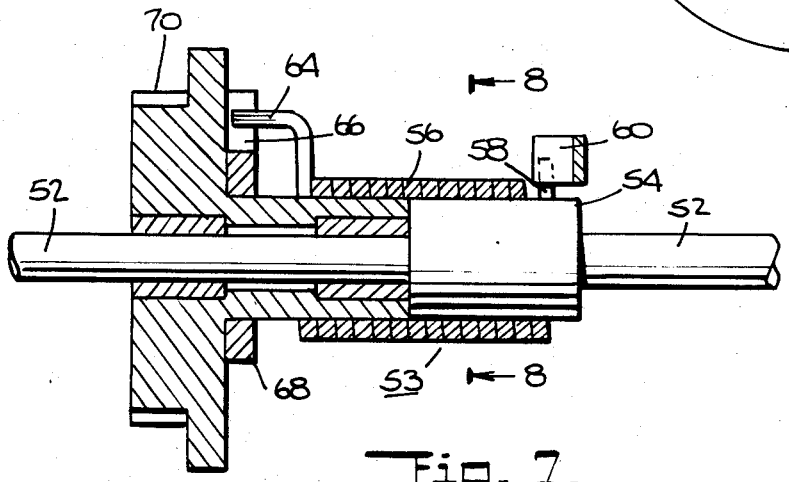
Fig. 7.

TAPE FEEDING APPARATUS FOR MAILING MACHINE

BACKGROUND OF THE INVENTION

1. Field of the Invention

The present invention relates generally to the field of mailing machines and more particularly to mailing machines of the type which have the capability of printing postage indicia either directly on an envelope or on a strip of gummed tape adapted to be affixed to an envelope or a package.

As is generally well known, a mailing machine includes a postage meter and a base component which generally has a feeding mechanism for feeding envelopes seriatim through the postage meter. The latter includes a printing mechanism which prints the postage indicia on the envelope, a mechanism for setting movable numerical printing wheels so that varying amounts of postage can be printed, and suitable mechanical or electronic registers which keep track of the amount of postage which has been printed to assure that the meter does not print a total amount of postage in excess of the amount initially credited to the meter by the Postal Service when the meter is set after the postage is paid for by the meter user.

Many mailing machines, especially those designed for use by the Postal Service or other organizations which handle packages in large volume, have the capability of printing the postage indicia on a strip of gummed tape in addition to printing the postage indicia directly on an envelope. There is a limit to the thickness of envelopes which can be fed through the mailing machine for printing of the postage indicia directly on the envelope, and it is of course obvious that packages cannot be fed through a mailing machine. Thus, for oversized envelopes and packages, the postage indicia is printed on a strip of gummed tape which is dispensed by the mailing machine printed and moistened and ready to be immediately affixed to the envelope or package. In such machines there is an activating trip lever in the path of the incoming envelope which activates the postage meter printing device to print a preselected amount of postage on the upper right hand corner of the envelope as is well known. There is also a manual activator which feeds a strip of tape to the postage meter and causes the postage meter to print the postage on the strip of tape and to dispense it from the mailing machine.

A major problem which exists with machines of the type described above is that it is possible to print more than one tape strip with the same amount of postage during any activation of the machine. Thus, if the manual activator is depressed, the mailing machine will continue to print postage indicia on successive tapes for so long as the activator is held depressed. Almost invariably, only one tape will be required for any given amount of postage for an oversize envelope or package because the next oversize envelope or package for which postage is required will be of a different weight and therefore will require a different amount of postage. Since the manual activator must be conveniently accessable to the mailing machine operator, it is quite possible that he may inadvertently hold the activator depressed for a longer period of time than is required for the mailing machine to print and dispense one tape. Also, the length of time required for some meters to print a single tape is very short, thereby increasing the likelihood of the mailing machine printing two tapes with the same amount of postage if the activator is not released immediately. The severity of this problem is better appreciated when one remembers that postage is money, and wasted postage tapes in any quantity results in considerable lost money.

2. Prior Art

So far as is presently known, only one prior mailing machine has been provided with any type of mechanism which would prevent the feeding of more than one piece of tape while a manual actuator for the tape feeding and postage printing mechanisms is held in an actuating position. That mailing machine is one manufactured and marketed by Pitney Bowes Inc., the assignee of this patent application, and has been commercially available since approximately 1960 as the Pitney Bowes model numbers 5400, 5600 and 6100 mailing machines. For further explanation of this mailing machine and for a discussion of the distinctions between it and the present invention, reference is made to the Prior Art Statement file concurrently with this application.

SUMMARY OF THE INVENTION

The present invention obviates or substantially eliminates the foregoing problems by providing a tape feeding apparatus which effectively prevents the feeding of a successive strip of tape unless and until the manual activator for the tape feeding mechanism has been allowed to return to its manual inoperative position from the operative position to which it was moved to cause the feeding of a prior strip of tape. This is accomplished in the present invention by providing a tape feeding apparatus having a tape feeding means, a means for driving the tape feeding means and a clutch interposed between the two. A latching mechanism normally maintains the clutch disengaged to prevent the driving means from driving the tape feeding means. A second clutch is interposed between the latching mechanism and a manually movable actuator, the second clutch being normally engaged to provide a direct connection between the actuator and the latching mechanism so as to disable the latching mechanism when the actuator is moved from a normal position to an actuating position, thereby allowing the first clutch to become engaged to cause the driving means to drive the tape feeding means. Finally, there is a means which is responsive to rotation of the first clutch assembly to disengage the second clutch assembly in order to allow the latching mechanism to reset so as to limit the rotation of the first clutch assembly to one revolution regardless of whether the manual actuator is held in the actuating position.

Therefore, having briefly described the present invention including a tape feeding apparatus which prevents feeding of successive strips of tape, it is mentioned that it is a principal object of the invention to provide a tape feeding apparatus which greatly simplifies the mechanism previously known to prevent undesired tape feeds.

It is another object of the present invention to provide an out of tape sensing mechanism which prevents feeding of tape when the tape supply has been depleted.

BRIEF DESCRIPTION OF THE DRAWINGS

FIG. 3 is a view taken along the lines 3—3 from FIG. 1, showing a top view of the one revolution clutch assembly and clutch assembly.

FIG. 4 is a section view taken along the lines 4—4 from FIG. 3, showing the clutch assembly and related components.

FIG. 5 is a section view taken along the lines 5—5 from FIG. 4, showing components relating to the wrap spring clutch in the clutch assembly.

FIG. 6 is an enlarged top view of the one revolution clutch assembly illustrated in FIG. 3.

FIG. 7 is a section view taken along the lines 7—7 from FIG. 6, showing the details of the one revolution clutch assembly.

FIG. 8 is a partial end view taken along the lines 8—8 from FIG. 7, showing components relating to the wrap spring clutch in the one revolution clutch assembly.

DETAILED DESCRIPTION OF THE INVENTION

Figure 1:
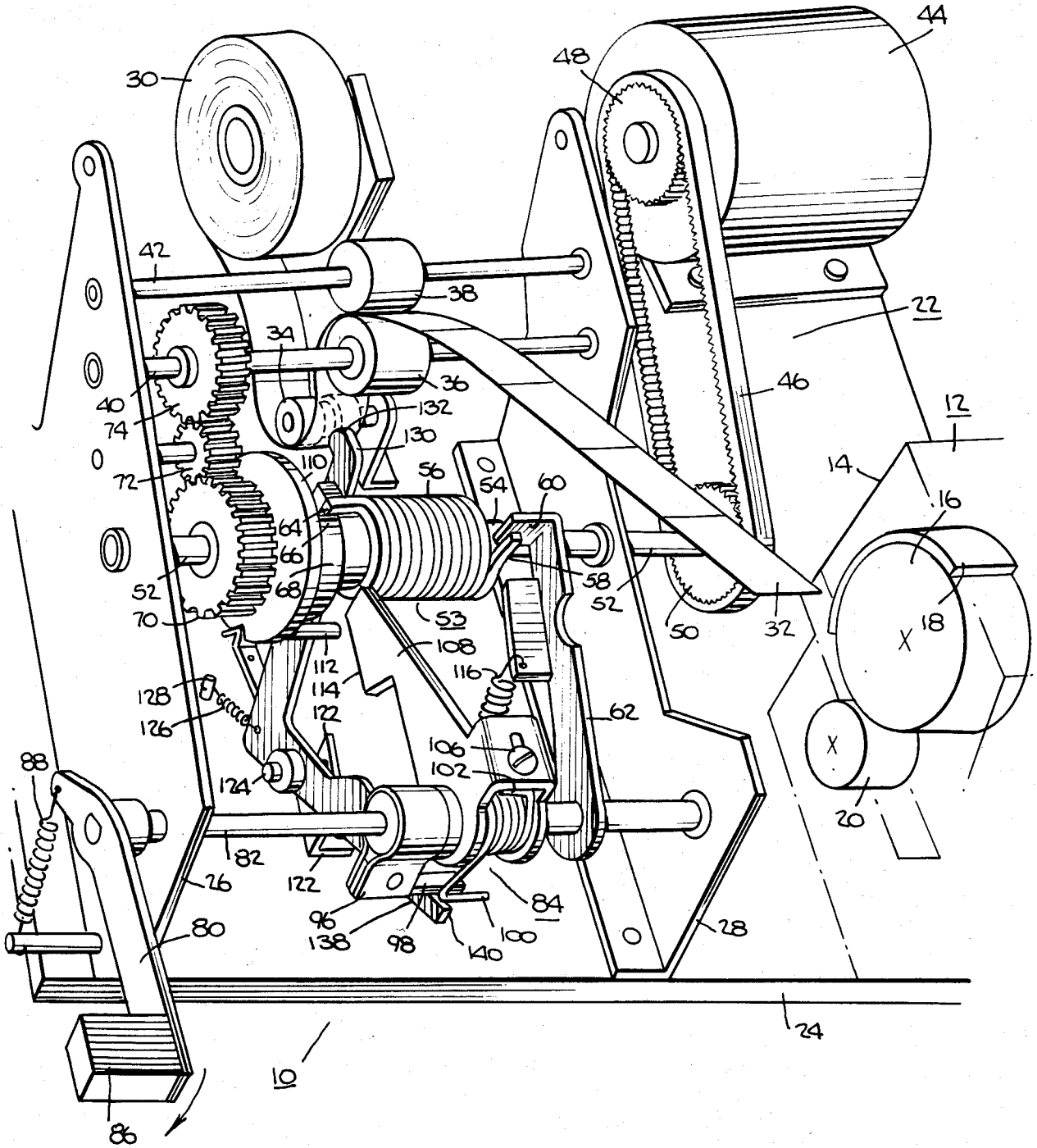
FIG. 1 is an isometric view of a tape dispensing apparatus of the present invention.
Figure 2:
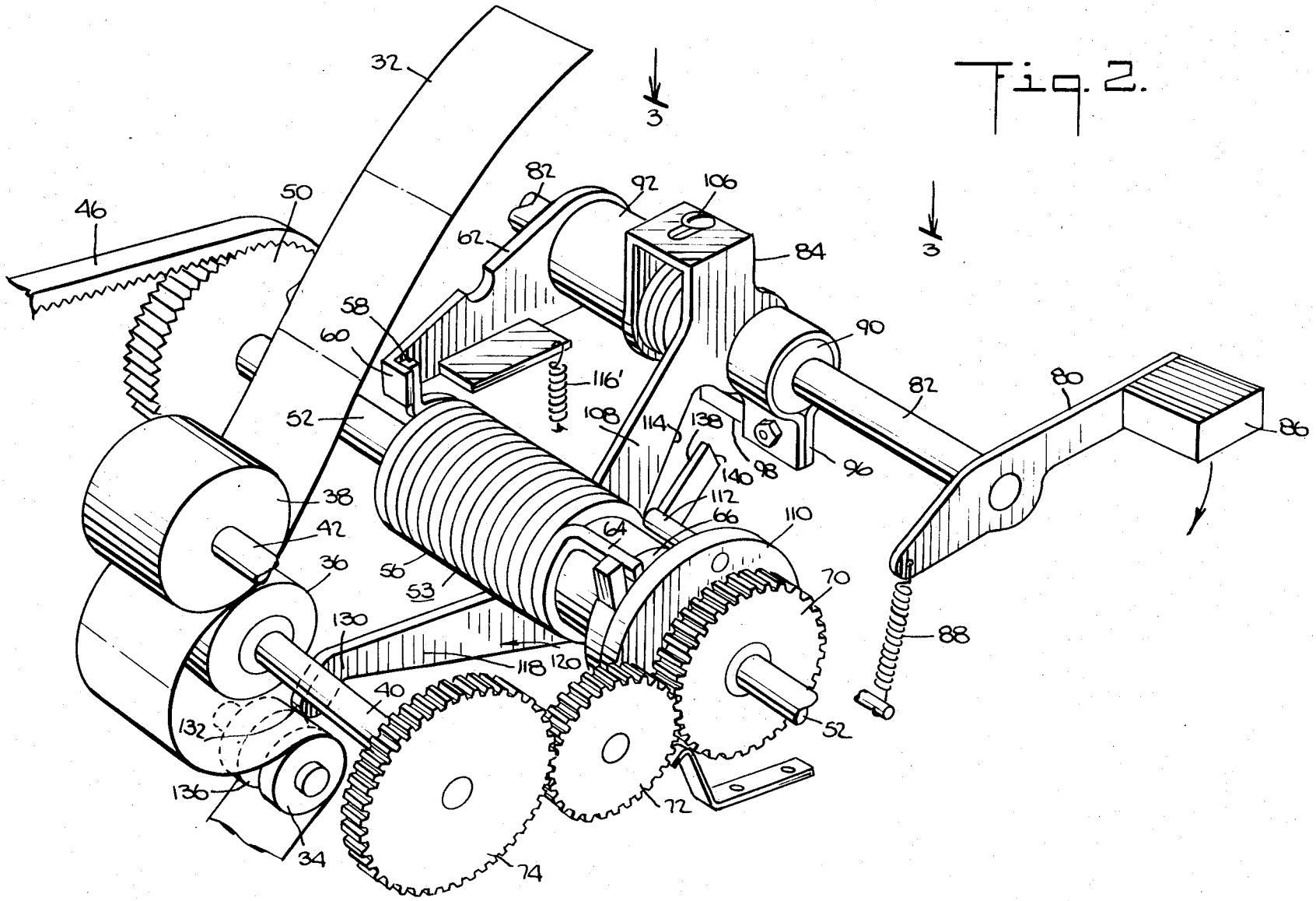
FIG. 2 is an enlarged isometric view of the one revolution clutch assembly, clutch assembly and associated instrumentalities of the present invention.

Referring now to the drawings, and more particularly to FIGS. 1 and 2 thereof, there is shown a portion of a representative mailing machine generally indicated by the reference numeral 10, recognizing that only so much of the mailing machine 10 is shown as is necessary to an understanding of the invention. The mailing machine 10 includes a postage meter generally indicated by the numeral 12, the meter 12 comprising a housing 14 which encloses all of the operating components of the meter for accomplishing the functions of setting various printing elements to print the desired amount of postage, setting various interval registers for keeping track of the amount of postage printed for accounting purposes and driving a printing drum 16 each time it is desired to print postage. None of the foregoing is necessary to an understanding of the present invention and therefore is not further described.

The meter 12 includes the aforementioned printing drum 16 which carries a postage impression die 18 on which is formed the familiar postage impression design. The drum 16 also includes settable print wheels (not shown) for printing the amount of postage and a date. A suitable back-up roller 20 maintains proper contact between an envelope or tape, as the case may be, and the printing die 18 to effect proper printing. The mailing machine 12 normally also includes appropriate structure for automatically feeding a succession of envelopes to the printing drum 16 so that postage is printed thereon at a high rate of speed. Again, this structure is not part of the present invention and has been omitted for the sake of clarity.

As indicated above and earlier in this specification, a typical mailing machine can print postage either directly on envelopes being fed through the postage meter or on a strip of gummed tape which is dispensed by the postage meter premoistened and ready to be affixed to a package or to an envelope which is too thick to be fed through the meter. The present invention deals with the apparatus for feeding such tape to the meter and is generally indicated in FIG. 1 by the numeral 22, and is sure to comprise a base plate 24 on which are mounted a pair of upstanding side plates 26 and 28 which in turn support most of the operating components of the tape dispensing apparatus 22. A supply 30 of tape is suitably mounted on the base plate 24 and a free end 32 of the tape passes around a guide roller 34 and between a pair of feed rollers 36 and 38 mounted on shafts 40 and 42 respectively which are supported by the side plates 26 and 28. The roller 36 is fixedly mounted on the shaft 40 for rotation therewith so that when the shaft 40 is rotated by means hereinafter described the feed rollers 36 and 38 will feed the end 32 of the tape to the printing drum 16 of the postage meter 12.

The drive train for the shaft 40 commences with a continuously operating motor 44 which drives a belt 46 through a pulley 48, the belt 46 driving another pulley 50 mounted on a shaft 52. The shaft 52 passes through a one revolution clutch assembly 53 which is normally held in a disengaged position so that the shaft 52 can rotate continuously without transmitting any driving force to the feed rollers 36 and 38.

As best seen in FIGS. 1, 2, 3, 6, 7 and 8, the one revolution clutch assembly 53 is seen to comprise an enlarged drum 54 formed on the shaft 52 and a helical torsion spring 56 wound around the length of the drum 54. One end tang 58 of the spring 56 is held captive by the free end 60 of a latching lever 62, the operation of which is fully described below. The other end tang 64 of the spring 56 is captured in a notch 66 formed in hub portion 68 of a gear 70 which is rotatably mounted on the shaft 52. The spring 56 is normally biased to tightly encircle the drum 54 in driving engagement therewith, and is held in non-driving engagement by the latching lever 62 engaging the tang 58 and thereby preventing the spring 56 from closing. When the latching lever 62 is disengaged from the tang 58, the spring 56 is free to contract under its natural resilience and grip the drum 54 in driving engagement therewith. The drum 54 then rotates the spring 56 which in turn rotates the gear 70 by virtue of the tang 64 being engaged in the notch 66 on the hub 68 of the gear 70. It will now be apparent that rotation of the gear 70 causes rotation of an idler gear 72 which in turn causes rotation of a gear 74 fixedly mounted on the shaft 40, thereby rotating the feed roller 36 to cause feeding of the end 32 of the tape from the supply 30.

As indicated above, the clutch assembly 53 just described is intended to permit only one revolution of the gear for each time the tape feed apparatus 22 is actuated, and this is controlled by the latching lever 62 and associated parts now to be described so that the latching lever 62 will re-engage with the tang 58 when the tang 58 has completed one revolution. Referring now to FIGS. 1, 2 and 3, a trip lever 80 is fixedly mounted on a shaft 82 which is mounted for rotation in the side plates 26 and 28, the lever 80 having a finger depressing knob 86 on one end for moving the lever 80 in a clockwise direction. The lever 80 is normally biased in a counterclockwise direction by the action of a tension spring 88 pulling on the opposite end of the lever 80. The latching lever 62 is rotatably carried on the shaft 82 and is moved in a clockwise direction with the shaft 82 through a second clutch assembly 84, although not a one revolution clutch assembly.

As best seen in FIGS. 4 and 5, the shaft 82 is provided with an enlarged base or drum portion 90, and an elongate bearing 92 having an outer diameter 93 equal to the diameter of the drum portion 90 is rotatably mounted on the shaft 82. A coil spring 94, similar to the spring 56 described above, is wrapped around both the drive portion 90 of the shaft 82 and a substantial portion of the bearing 92 and is normally biased to remain tightly wound on the drum portion 90 and the bearing 92 so as to grip both the drum portion 90 and the bearing 92 which is understood to be attached to the lever 62, thereby effecting a driving engagement between these parts. Thus, when the trip lever 80 is depressed, the shaft 82 rotates to raise the latching lever 62 thereby releasing the spring 56 to commence a tape feeding cycle.

As best seen in FIG. 1, a suitable bracket 96 is affixed to the shaft 82, the bracket 96 having an abutment member 98 suitably located so as to abut the lower end tang 100 of the spring 94, thereby preventing clockwise movement of this tang except upon corresponding movement of the bracket 96 and the shaft 82. The other end tang 102 bears against a nut 104 secured by a screw 106 to the upper surface of a release lever 108 which is rotatably carried by the shaft 82. The spring 94 is adjusted such that a very slight movement in a clockwise direction of the upper tang 102 while the lower tang 100 is held stationary is sufficient to open the spring 94 to release the driving connection between the drive portion 90 of the shaft 82 and the bearing 92.

The release lever 108 operates in response to movement of the one revolution clutch assembly 53 previously described. It will be seen that the gear 70 includes a flange 110 which carries a pin 112 for rotation with the gear 70. The release lever 108 has an abutment surface 114 (FIG. 1) against which the pin 112 bears shortly after the gear 70 begins to rotate. During rotation of the gear 70, the pin 112 rocks the release lever 108 in a clockwise direction thereby pushing the upper end tang 102 of the spring 94 in a clockwise direction to open the spring 94 and interrupt the driving connection between the drum portion 90 and the bearing 92. As soon as the pin 112 passes the end of the release lever 108, it returns to its original position under the influence of the coil spring 94, thereby permitting the spring 94 to re-establish a driving connection between the drum portion 90 of the shaft 82 and the bearing 92. However, in the brief time during which the spring 94 was loose and not effecting a driving engagement between the drum portion 90 and the bearing 92, the latching lever 62 is allowed to return to its normal position under the influence of a spring 116 (FIG. 1) with the latching finger 60 again engaging the upper end tang 58 of the spring 56 to prevent further rotation thereof.

A further feature of the present invention is the provision of an end of roll sensor 118 (FIG. 2) which functions to prevent further operation of the tape feeding mechanism 22 when the supply of tape in the mailing machine is exhausted, and does so in cooperation with the same structure which prevents more than one cycle of operation of the tape feeding mechanism 22 when the manual actuator (lever 80), for the tape feeding mechanism 22 and the postage printing mechanism are held in an actuating position. Thus, with reference to FIGS. 1 and 2, there is seen a tape sensing lever 120 pivotably mounted on a suitable pin or screw 124 on a bracket 122, the lever 120 being normally urged in a counter-clockwise direction about the pin 124 by means of a spring 126 connected to the lever 120 and to a pin 128 connected to the base 24. The lever 120 has an upwardly directed rear leg portion 130 which terminates in a nose 132 which is adapted to bear against the end 32 of the tape as the tape passes over the roller 34, which has a centrally located groove 136. It will be apparent that when the supply roll 30 and the end 32 of the tape is depleted, the nose 132 of the lever 120 will drop into the groove 136 under the influence of the tension spring 126.

The tape sensing lever 120 also has a forwardly projecting leg 138 which has an end 140 disposed adjacent the lower end tang 100 of the spring 94. When the presence of tape keeps the tape sensing lever 120 from moving under the influence of the spring 126, the end 140 of the lever 120 is disposed beneath the lower end tang 100 of the spring 94 and therefore cannot engage the tang 100 regardless of any movement of the latter. However, when the tape 32 runs out and the lever 120 pivots in a counter-clockwise direction so that the nose 132 rests in the groove 136 of the roller 134, the end 140 of the lever 120 moves upwardly to a position in which it is disposed in the path of movement of the lower tang 100 thereby preventing the tang 100 from moving in a clockwise direction when such movement is otherwise permitted by corresponding movement of the abutment member 98 when the knob 86 of the lever 80 is depressed. The abutment member 98 is adjusted so as to hold the lower tang 100 in a position to maintain the spring 94 in an unwrapped or non-driving condition such that only a very small amount of clockwise movement of the tang 100 is necessary to permit the spring 94 to wrap onto the drum position 90 to effect a driving connection to the bearing 92. When the end 140 of the tape sensing lever 120 moves into the position described above, the tang 100 cannot move in a clockwise direction to wrap the spring 94 when the tape lever 80 is depressed thereby preventing the latching lever 62 from being raised which in turn prevents the tape drive mechanism from operating.

Therefore, having described the present invention in the foregoing specification, it will be apparent that a tape dispensing apparatus is provided in which the utility of the apparatus is greatly improved over the existing prior art. Further, that the advantages and objectives of the present invention have been achieved. It is to be understood, however, that the invention is not to be considered as limited to the specific embodiment described above and shown in the accompanying drawings which embodiment is merely illustrative of the best mode for carrying out the invention and is susceptible to change in form, size, detail and arrangement of parts, but rather that the invention is intended to cover all such variations, modifications and equivalents thereof as may be deemed to be within the scope of the claims appended hereto.

What is claimed is:

1. In a mailing machine having a supply of tape and a printing instrumentality for printing postage indicia on a discrete portion of the tape, a tape feeding apparatus for feeding only a single discrete portion of the tape to the printing instrumentality each time the mailing machine is activated, said tape feeding apparatus comprising:

A. means for feeding tape from the supply thereof,

B. means for driving said tape feeding means,

C. a first clutch assembly interposed between said feeding means and said driving means, D. latching means normally maintaining said first clutch disengaged to prevent said driving means from driving said feeding means, E. a manually movable actuating means for initiating operation of said tape feeding means, F. a second clutch assembly interposed between said actuating means and said latching means for disabling said latching means when said actuating means is moved to an actuating position to permit said first clutch to engage to cause said driving means to drive said tape feeding means, and G. means responsive to rotation of said first clutch assembly to disengage said second clutch assembly to reset said latching means thereby limiting rotation of said first clutch assembly to one revolution regardless of whether said manual actuating means is held in said actuating position.

2. A tape dispensing apparatus as set forth in claim 1 wherein said first clutch assembly comprises a first input drive member connected to said driving means, a first output drive member connected to said tape feeding means and a first coil spring encircling said first input drive member and being connected to said first output drive member, said first coil spring being normally biased to effect a driving connection between said first input and output drive members.

3. A tape dispensing apparatus as set forth in claim 2 wherein said second clutch assembly comprises a second input drive member connected to said actuating means, a second output drive member connected to said latching means and a second coil spring encircling said second input drive member and said second output drive member, said second coil spring being normally biased to effect a driving connection between said second input and output drive members.

4. A tape dispensing apparatus as set forth in claim 3 wherein said latching lever mounted on said second output drive member and being normally biased to a position where said latching lever is engaged with one end of said first coil spring to hold said first coil spring in an open non-driving condition against the normal bias of said first coil spring, said latching being effective to disengage with said one end of said first coil spring to allow said first coil spring to close when said actuating means is moved to an actuating position.

5. A tape dispensing apparatus as set forth in claim 4 wherein said actuating means comprises a movable lever connected to said second input drive member and including an abutment member positioned to engage with one end of said second coil spring to maintain said second coil spring in an open non-driving condition when said lever is in a normal non-operative position.

6. A tape dispensing apparatus as set forth in claim 5 wherein said means to disengage said second clutch comprises a movable release lever having an abutment means positioned to engage with and move the other end of said second coil spring when said lever is moved from a normal position in which said abutment means is not effective to move said other end of said second spring to a release position in which said abutment means moves said other end of said second spring to open said second spring thereby disconnecting the driving engagement between said second input and output drive members, whereupon said latching member can return to its latching position.

7. A tape dispensing apparatus as set forth in claim 6 wherein said first clutch assembly includes an abutment member mounted on said first output drive member, said abutment member being positioned to engage an end of said release lever after a predetermined amount of rotation of said first output member so as to cause said release lever to move from said normal position to said release position to disengage said second clutch assembly.

* * * * *